United States Patent [19]

Craighero

[11] 4,301,970

[45] Nov. 24, 1981

[54] POWERED AEROSOL SPRAY DEVICE

[76] Inventor: Margherita Craighero, Largo del Pecile 5, 33100 Udine, Italy

[21] Appl. No.: 50,338

[22] Filed: Jun. 20, 1979

[30] Foreign Application Priority Data

Jun. 20, 1978 [IT] Italy ..... 83405 A/78

[51] Int. Cl.[3] ..... B05B 7/26

[52] U.S. Cl. ..... 239/338; 239/214.21; 239/370; 239/371; 108/200.17

[58] Field of Search ..... 239/214.21, 214.25, 239/215, 219, 224, 338, 369-371, 432, 702, 703; 128/200.17, 200.18; 261/91; 55/235, 257 R, 257 C, 259, 446; 118/621

[56] References Cited

U.S. PATENT DOCUMENTS

| | | | |
|---|---|---|---|
| 1,125,966 | 1/1915 | Combemale | 55/446 |
| 1,864,797 | 6/1932 | Braemer | 239/214.21 X |
| 2,221,010 | 11/1940 | Vliet | 261/91 X |
| 2,607,573 | 8/1952 | Hession, Jr. | 239/214.21 X |
| 2,845,894 | 8/1958 | McIlvaine | 118/621 X |
| 3,049,301 | 8/1962 | Heuschkel | 118/621 X |
| 3,229,450 | 1/1966 | Stern | 261/91 X |
| 3,283,478 | 11/1966 | Katzman et al. | 261/91 X |
| 3,365,181 | 1/1968 | Schwaneke | 261/91 X |
| 3,853,456 | 12/1974 | Mutchler | 239/214.21 X |
| 4,116,387 | 9/1978 | Kremer, Jr. et al. | 239/338 |

*Primary Examiner*—Robert W. Saifer
*Attorney, Agent, or Firm*—Omri M. Behr

[57] ABSTRACT

A powered aerosol spray device includes an internally disposed motor, a fluid reservoir and a baffle arrangement for filtering a liquid and air mixture in order to provide a fine micelles controlled spray.

4 Claims, 6 Drawing Figures

POWERED AEROSOL SPRAY DEVICE

BACKGROUND OF THE INVENTION

1. Field of the Invention

The present invention relates to aerosol spray devices, and in particular to, aerosol spray devices having an internally disposed power source.

2. Description of the Relevant Art

Many types of aerosol spray devices are known in the art, however, few of these are capable of providing a non-wetting aerosol with a liquid substance. In order to provide an aerosol spray with a liquid substance requires that very minute particles called micelles be obtained. These must be dispersed into the air and will stay there for long periods of time. If the micelles are contained within a very precise dimensional field, they will not wet the surfaces with which they come into contact and in this way, the appearance of residual condensation on active or passive objects is avoided.

Obtaining this result is generally very important in providing an aerosol spray, but even more so, where the liquid substances to be used are toxic and must be kept within a prescribed concentration in the atmosphere. Liquid substance used in the aerosol spray has to be present in the atmosphere at a precise minimum concentration to enable it to function as designed. For instance, this is true with a sterilizing or disinfectant substance which may be required to disinfect or sterilize the premises while at the same time providing safety with regard to humans or animals which may be in the proximate area.

It is well known that micelles remain suspended in the gaseous composition of the atmosphere and are provided with a continuous, rapid movement of agitation (the so-called Braun motion). To enhance this agitation and thereby the dynamic activity of the micelles, it is desirable to introduce an electrostatic charge to the micelles which will increase the agitation of the micelles as well as the length of time they may be suspended in the atmosphere.

It is also known that it is very difficult to define or control the substance forming the aerosol spray so that it covers a very limited surface area since it has the capability of covering large areas. Indeed it is well known that a sphere of liquid having a diameter of 1 cm has a surface area of approximately 3 sq. cm and a volume of about 0.5 cubic cm. If suitably made into an aerosol spray the same volume is capable of producing 1 billion (1,000,000,000) micelles, which is capable of covering, when positioned exactly in contact with each other, a surface of 3 sq. m. which is 10,000 times greater than the starting surface. Obviously then, the area of a liquid made into an aerosol spray becomes huge, and the great quantity of micelles spread in the air insures the bombardment and thereby the death of the microbic flora polluting the atmosphere or the surface of the premises sprayed. Therefore it is an object of the present invention to provide a device for producing aerosol sprays of liquid substances so that the micelles are between 0.3 and 13 microns.

Another object of the present invention is to provide a device for mixing aerosol sprays with liquid substances to form micelles having a diameter of between 0.3 and 15 microns without modifying the temperature of the solution.

Another object of the present invention is to be able to provide an electrostatic charge in micelles prior to their entering the atmosphere.

Another object of the present invention is to provide an aerosol spray of disinfectants which may be carried on in the presence of human beings.

SUMMARY OF THE INVENTION

A powered aerosol spray device, according to the principles of the present invention, comprises reservoir means for storing liquid which is to be sprayed in fine micelles, a hollow housing disposed upon the reservoir and including first aperture means for permitting communication therebetween, the housing further including second aperture means through which the fine micelles leave the housing and third aperture means for providing intake air from the atmosphere. A motor means is disposed within the housing with its driveshaft extending downwardly towards the reservoir. The motor means is adapted to be connected to a source of electrical energy. Impeller means is affixed upon the motor drive shaft. Means are affixed to the motor drive shaft and disposed within the first aperture means for directing the liquid upwardly towards the impeller means for mixing with the intake air. Additionally, means are provided for filtering the liquid engaging the micelles prior to the micelles leaving the second aperture means.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT

Figure 1:
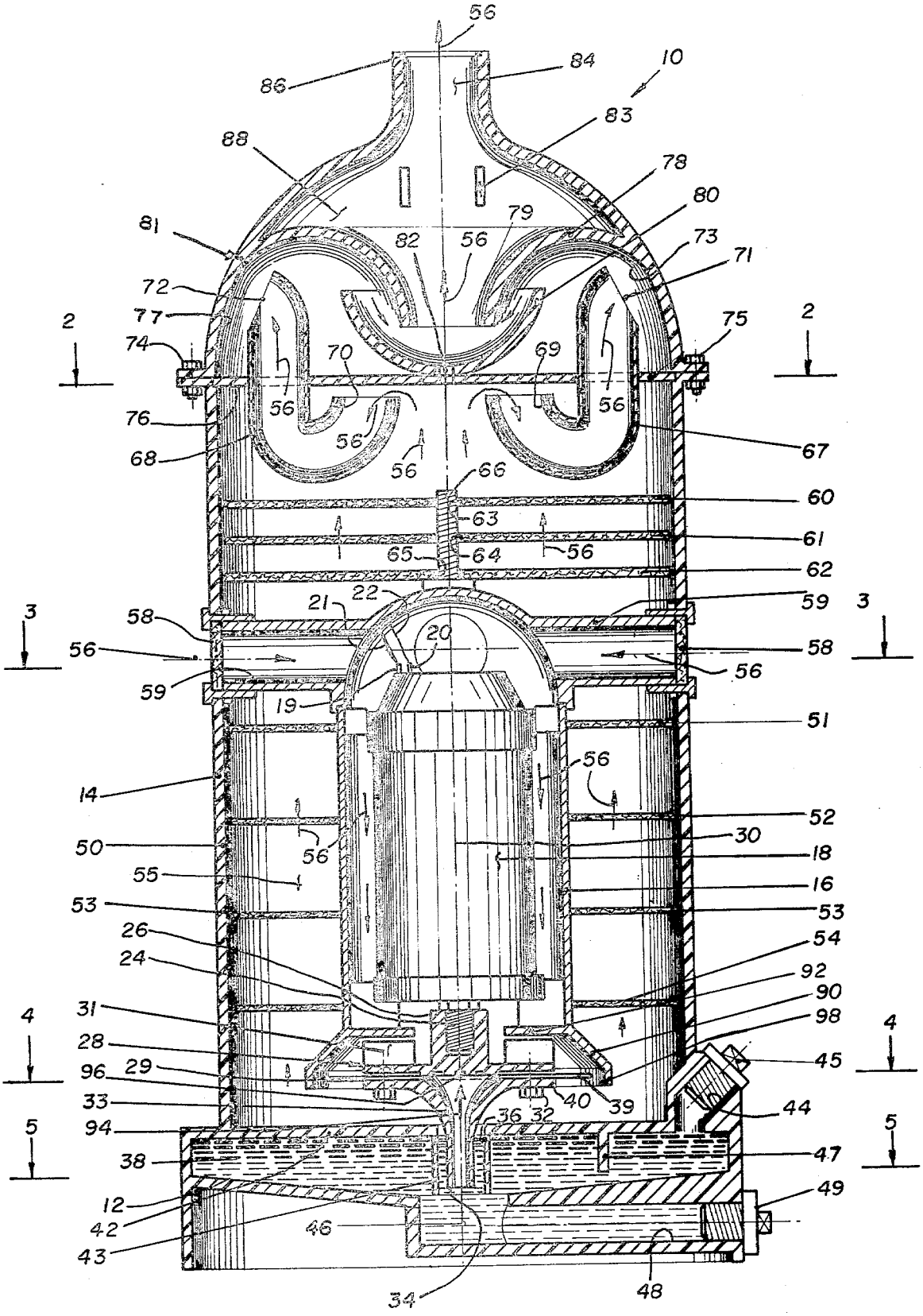
FIG. 1 is a cross-sectional view in elevation of a powered aerosol spray device, according to the principles of the present invention.
Figure 2:
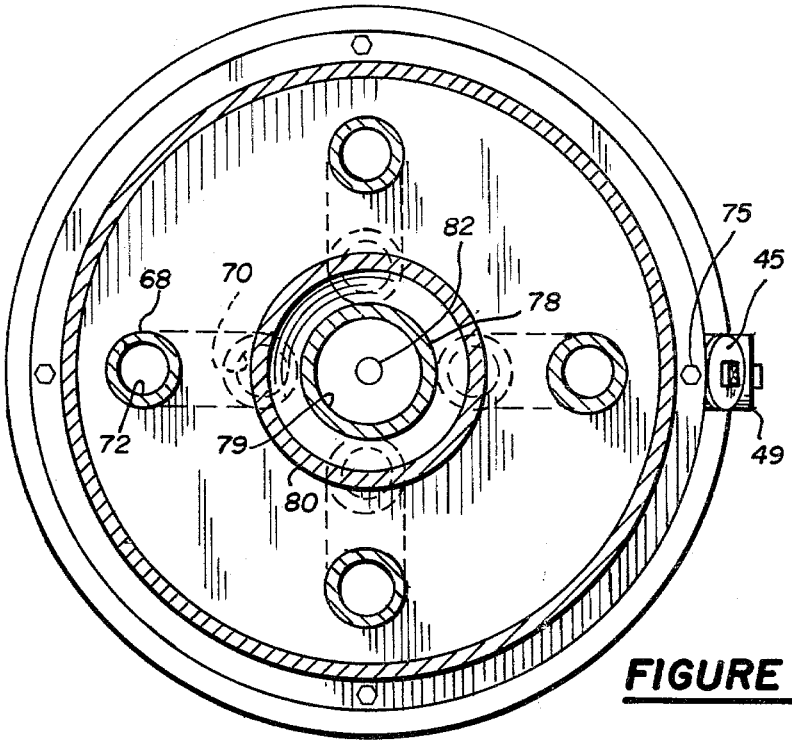
FIG. 2 is a plan view taken along the line of 2—2 of FIG. 1.
Figure 3:
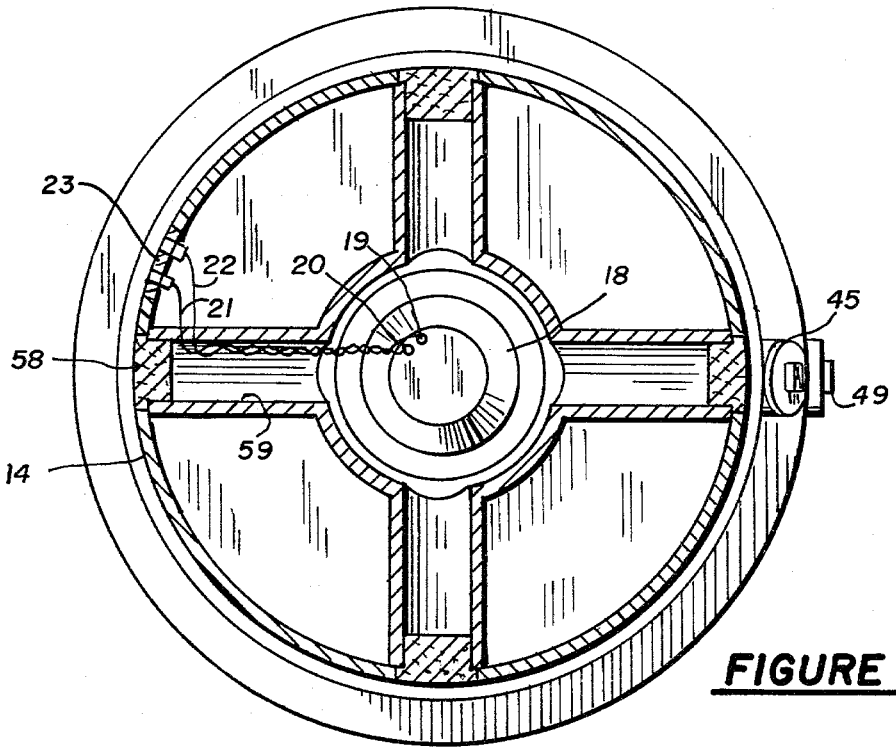
FIG. 3 is a plan view taken along the line of 3—3 of FIG. 1.
Figure 4:
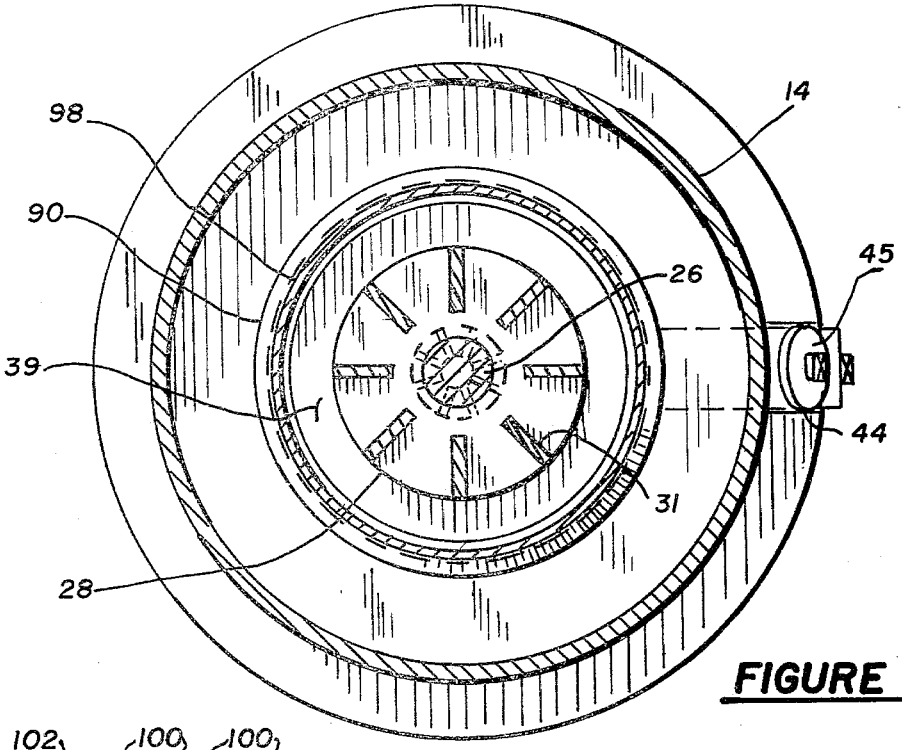
FIG. 4 is a plan view taken along the line 4—4 of FIG. 1.

Referring to the figures, and more particularly to FIGS. 1-5 which shows an aerosol spray 10 that includes a reservoir 12 disposed at the bottom portion thereof and a hollow housing 14 disposed thereon. An inner container 16 is centrally disposed in the lower portion of the housing 14 and is adapted to receive, in a conventional manner, a motor 18. The motor 18 is provided with input terminals 19 and 20 which are connected, via a pair of wires 21 and 22 (shown in FIG. 3), to an output connector 23. Connector 23 is connected, via a mating connector and lead wire, not shown, to a source of electrical energy, not shown, suitable for operation of the motor 18. The motor shaft 24 extends in a downwardly direction and is preferably provided with threads on the distal end thereof for receiving the mating hub portion 26 of an impeller 28. The impeller 28 has a generally flat portion 29 which extends outwardly transverse to the central axis 30 of the drive motor 18. The upper surface of the impeller flat portion 29 has provided thereon a plurality of vertically positioned blades 31 disposed about the surface of the flat portion. The impeller blades 31 extend outwardly similarly to the spokes of a wheel towards the outer circumference of the impeller flat portion 29 and are spaced away from the hub portion 26. Preferably the blades 31 are equally spaced so that the impeller may be centrifugally balanced.

Affixed to the underside of the flat portion 29 by a plurality of nuts and bolts 32, a generally conically-shaped suction pipe 33 which has its apex 34 extending downwardly into an aperture 36 provided between the bottom of the housing 14 and the reservoir valve which contains a liquid 38. A centrifugal lamination plate 39 is disposed between the lower surface of the flat portion 29 and the upper surface of the flange portion 40 of the suction pipe 33 and held firmly therebetween by nuts and bolts 32. The function of the centrifugal lamination plate 39 will be discussed hereinafter.

The wall 42 separating the housing 14 from the reservoir 12 is provided with centrally disposed cylindrically-shaped portion 43 which extends downwardly into the reservoir liquid 38 about the apex of the suction pipe 33 thereby reducing turbulence in the liquid 38 which may occur because of the rotation of the suction pipe 33 when the motor 18 is energized.

The reservoir 12 additionally includes an input aperture 44 into which the liquid to be dispensed is inserted. The aperture 44 may be closed by utilizing a plug 45 adapted to be received therein. Alternatively, plug 45 may be removed during operation and a continuous flow of liquid be provided through the input aperture 44. A baffle 47 is provided proximate the input aperture 44 to prevent liquid being inserted into the reservoir during operation from causing undue turbulence to the liquid already in the reservoir.

A sediment settling sump 46 is also provided in the reservoir 12. Preferably the sump is centrally disposed beneath the aperture 36 permitting any sediment occurring in the liquid 38 to settle downwardly and be available to the sediment removal aperture 48 which is normally kept sealed by a plug 49 placed therein.

The middle portion 50 of the housing 14 is provided with a plurality of filter baffles 51, 52, 53 and 54 disposed in the air flow path 55 provided between the outer surface of the inner container 16 and the inner surface of the housing 14. The air flow is in the direction of arrows 56. The ambient air flows through input filter 58, into ducts 59, into the area surrounding the motor 18 within the container 16, towards impeller blade, into the air flow path 55 where it encounters filters 51, 52, 53, and 54 and flows through additional filter baffles 60, 61 and 62. Filter baffles 60, 61 and 62 are provided with a centrally disposed threaded aperture 63, 64 and 65 which is adapted to be received onto threaded stud 66 in order to retain the filter in position.

The air flow then continues upwardly and flows through ducts 67 and 68, entering the openings 69 and 70, respectively, and exits via openings 71 and 72, respectively. The air flow then interacts with the essentially vertical walls 73 and 77 of the upper or cover portion 81 of housing 14 which is affixed to the middle portion 50 of the housing 14 by means of nuts and bolts 74 and 75. The air ducts 67 and 68 are affixed in a retaining barrier 76 which effectively closes off the air flow except for the path provided through the ducts 67 and 68. The air exiting from openings 71 and 72 encounters an annular deflecting elements 78 and 79 respectively where it reverses the air flow path by cooperating with a cooperating hood element 80. The hood element 80 is provided with a drain aperture 82 permitting any micelles that adhere and condense to fall therethrough and drop back through the filters. They may eventually work back to the reservoir or be picked up by the air flow stream again. The air flow laden with micelles then passes through a filter barrier 83 which may be used to electrostatically charge the micelles as they leave the exit aperture 84 of the aerosol spray device 10. The exit aperture 84 is additionally provided with a slotted disc 86 in the opening thereof to control the spray pattern. The slotted disc may be fabricated of a magnetic material thereby magnetically affecting the micelles as they leave the exit aperture 84. The space 88 directly above the deflecting elements 78 and 79 functions as an expansion chamber for the air leaving the exit aperture 84.

In order to control the air flow from the air intake filter, via the motor, a barrier and deflecting means 90 is annularly disposed around the shaft 24 of the motor and impeller 28 to direct the air saturated with the micelles into the outgoing air stream. Additionally included is a toric barrier 92 which is annularly disposed about the shaft 24 of the motor 18 and the hub portion of the impeller 28 to deflect the intake air onto the impeller blades 31.

In operation, the motor is energized causing the impeller 28 to rotate simultaneously with the centrifugal lamination of the plate 39 and the suction pipe 33. This causes the liquid 38 in the reservoir to flow upwardly in the direction of arrows 94 where it then flows through apertures 96 and is dispersed on the upper surface of centrifugal lamination plate 39. The fluid then moving at a very rapid rate is deflected onto the barrier and deflecting means 90 and the annular retaining wall 98 where it comingles with incoming air being forced off the vertical blades 31. The incoming air moving at a rapid speed over the centrifugal lamination plate and the inner walls of the barrier deflecting means 90 absorbs the micelles and proceeds to carry them in the direction of arrows 56. The micelles passing through the filter baffles then are measured and gaged to the proper size.

Figure 6:
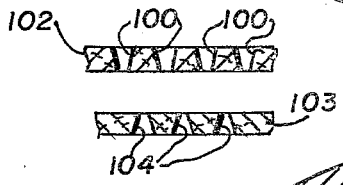
FIG. 6 is an enlarged partial view of two gaging filters utilized in the instant invention.
Figure 5:
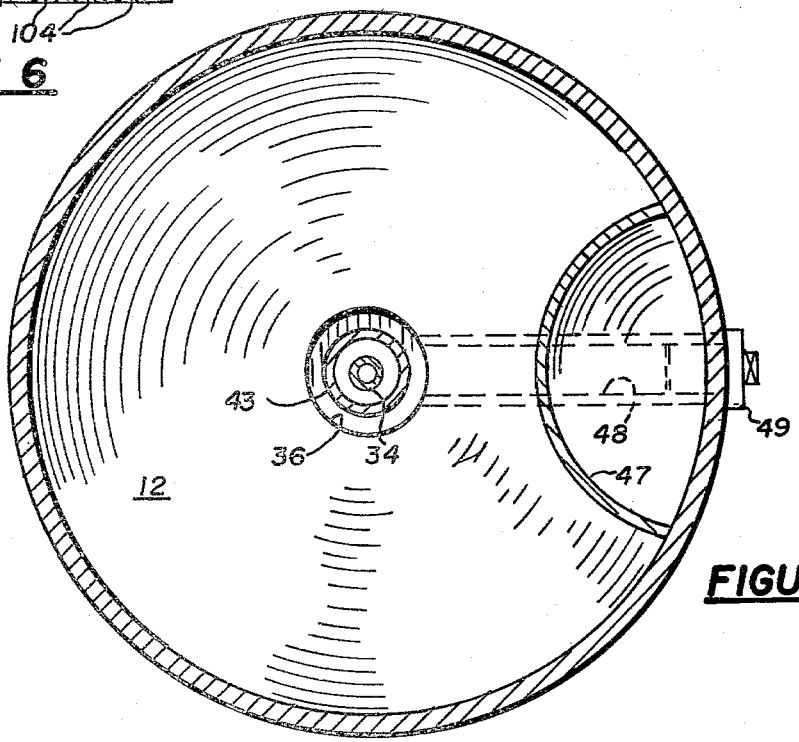
FIG. 5 is a plan view taken along the line 5—5 of FIG. 1.

It is to be noted that the baffles are positioned such that the apertures 100 provided therein (refer to FIG. 6) are, for example, conically shaped with the narrow portion of the opening facing in a downwardly direction such that the apertures 100 in baffle plate 102, being proximate filter baffle 103 has the apertures 104 in the opposite position, whereby the narrow portion of aperture 104 is disposed proximate the narrow portion of aperture 100. It is also to be noted that the baffle apertures 100 and 104 are specifically staggered so that the micelles flowing through one set of apertures are not permitted to directly flow through the aperture in the adjacent baffle. Thus, the micelles are continually broken up and filtered until they are reduced to the proper size, preferably in the range of 0.3 to 15 microns. When aerosol spray is to be used for germicidal purposes, the micelles should preferably be in the range of 0.5 and 6 microns; and when utilized to cover surfaces, the micelles are generally between 6 and 10 microns, thus avoiding disagreeable "wetting action" which is typical of conventional spraying apparatuses.

Thus, the micelles striking the barriers in the baffle have a path which enables them to fall backward towards the reservoir, while the micelles passing through the apertures in the baffle will continually be expanded in volume and then gaged before passing on to the next filter baffle and eventually out the exit aperture.

Hereinbefore has been disclosed a novel aerosol spray apparatus which includes an internally housed motor capable of providing the necessary air flow to propel the micelles through the housing and out the exit aperture. In the configuration disclosed it is possible to introduce an electrostatic or electromagnetic charge to the micelles before they leave the exit aperture.

Having thus set forth the nature of the invention, what is claimed is:

1. A powered aerosol spray device comprising:

(a) reservoir means for storing liquid which is to be sprayed in fine micelles;

(b) a hollow housing disposed upon said reservoir and including;

(i) first aperture means for permitting communication therebetween, (ii) second aperture means through which said fine micelles leave said housing, (iii) third aperture means for providing intake air from the atmosphere, (iiii) an inner container including fourth aperture means, and (iiiii) air duct means, said air duct means connecting said fourth aperture means to said third aperture means for providing a continuous intake inflow path;

(c) motor means disposed within said housing and centrally disposed within said fourth aperture means with its drive shaft extending downwardly towards said reservoir, said motor means being adapted to be connected to a source of electrical energy;

(d) impeller means affixed upon said motor drive shaft disposed within said intake air flow path;

(e) means affixed to said motor means drive shaft and disposed within said first aperture means for directing said liquid upwardly towards said impeller means for mixing with said intake air; and (f) means for filtering said liquid and gaging said micelles prior to said micelles leaving said second aperture means.

2. A powered aerosol spray device according to claim 1 wherein said means for filtering and gaging said micelles includes a plurality of filter baffles which gage the micelles in a progressively more selective manner in the direction of the outlet aerosol mixture flow towards said second aperture, said filtering means including a plurality of baffles having a plurality of apertures therein, said apertures being conically-shaped with the wider portion thereof in one baffle facing the narrower portion thereof in said adjoining baffle, said apertures in alternate baffles being staggered.

3. A powered aerosol spray device according to claim 1 wherein said air path after said baffle means is closed by a retaining barrier, said barrier being provided with a through duct having its inlet disposed proximate said retaining barrier and its outlet disposed proximate a generally vertical wall, said barrier being provided with drain aperture means for draining off liquid condensate.

4. A powered aerosol spray device according to claim 1 further including at least one annular deflecting element and a cooperating hood element means for reversing the air flow path, said hood element means being provided with aperture drain means for draining off liquid condensate.

* * * * *